US005716233A

United States Patent [19]

Muzslay

[11] Patent Number: 5,716,233

[45] Date of Patent: Feb. 10, 1998

[54] CONTACT POSITION ASSURANCE DEVICE

[75] Inventor: Steven Zoltan Muzslay, Huntington Beach, Calif.

[73] Assignee: ITT Corporation, New York, N.Y.

[21] Appl. No.: 565,326

[22] Filed: Nov. 30, 1995

[51] Int. Cl.[6] ..... H01R 13/40

[52] U.S. Cl. ..... 439/595

[58] Field of Search ..... 439/595, 744, 439/752

[56] References Cited

U.S. PATENT DOCUMENTS

| | | | |
|---|---|---|---|
| 3,937,545 | 2/1976 | Cairns et al. | 339/60 |
| 3,971,613 | 7/1976 | Kobler | 339/59 |
| 4,544,220 | 10/1985 | Afello et al. | 339/59 |
| 4,557,542 | 12/1985 | Coller et al. | 339/59 |
| 4,565,416 | 1/1986 | Rudy et al. | 339/59 |
| 4,602,837 | 7/1986 | Sian et al. | 339/59 |
| 4,636,020 | 1/1987 | Marmillion | 439/595 |
| 4,714,437 | 12/1987 | Dyki | 439/595 |
| 4,749,372 | 6/1988 | Betsui | 439/587 |
| 4,749,373 | 6/1988 | Brekosky et al. | 439/595 |
| 4,776,813 | 10/1988 | Wilson et al. | 439/587 |
| 4,826,452 | 5/1989 | Sian et al. | 439/595 |
| 4,902,247 | 2/1990 | Suzuki et al. | 439/595 |
| 4,936,798 | 6/1990 | Hass et al. | 439/752 |
| 4,944,695 | 7/1990 | Tsuji et al. | 439/595 |
| 4,963,106 | 10/1990 | Wendling et al. | 439/595 |
| 4,973,268 | 11/1990 | Smith et al. | 439/595 |
| 5,071,369 | 12/1991 | Denlinger et al. | 439/595 |
| 5,108,318 | 4/1992 | Sakurai et al. | 439/595 |
| 5,122,080 | 6/1992 | Hatagishi et al. | 439/595 |
| 5,135,416 | 8/1992 | Hass et al. | 439/752 |
| 5,273,443 | 12/1993 | Frantz et al. | 439/595 |

*Primary Examiner*—Neil Abrams
*Assistant Examiner*—Christopher Goins
*Attorney, Agent, or Firm*—Freilich Hornbaker Rosen

[57] ABSTRACT

A contact position assurance device is provided that indicates incomplete installation of a contact and that also prevents loss of a fully installed contact. Contact-receiving passages (12, FIG. 3) are arranged in groups of three that are clustered about a group axis (84), and an assurance post (82) projects into a hole lying at the group axis and can engage a first tine (44A) lying at each passage. The first tine includes an arm (90) extending forwardly from a tine abutting part (70) that engages a contact shoulder (72). If the contact (40) has been fully installed, the post substantially abuts a radially outer surface of the arm. However, if the contact has not been fully installed, the post engages a front end (112) of the tine arm, which prevents full rearward insertion of the post.

7 Claims, 4 Drawing Sheets

FIG. 4
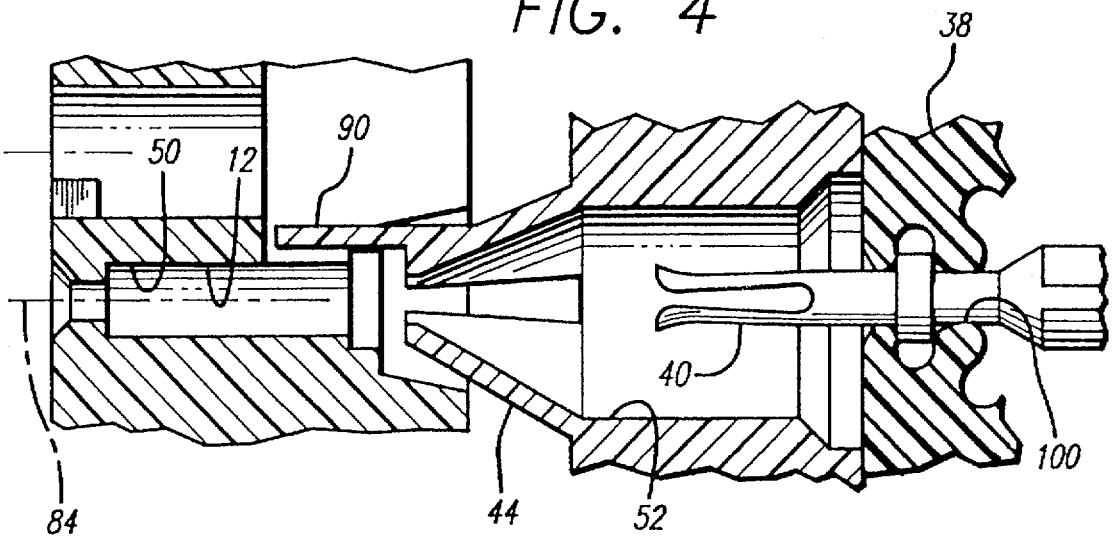
FIG. 5
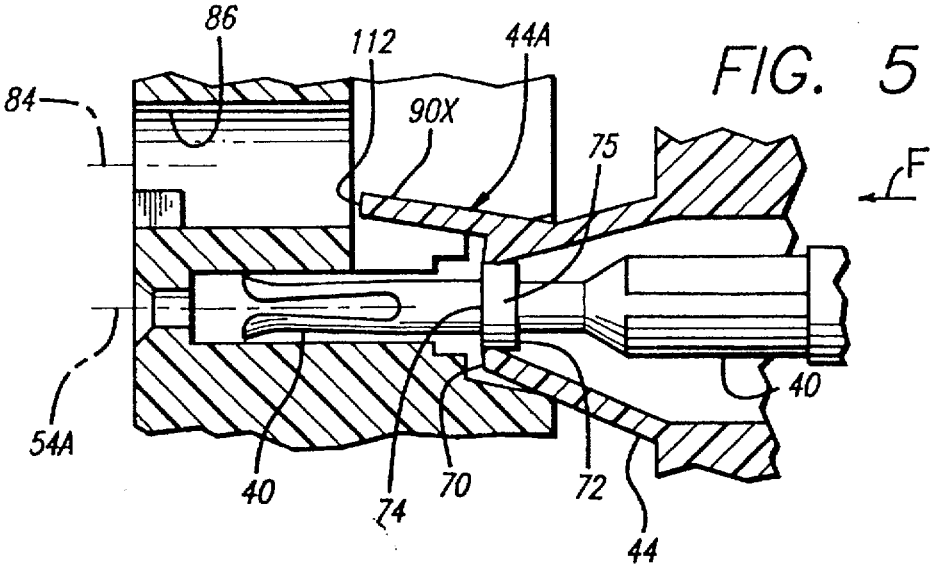
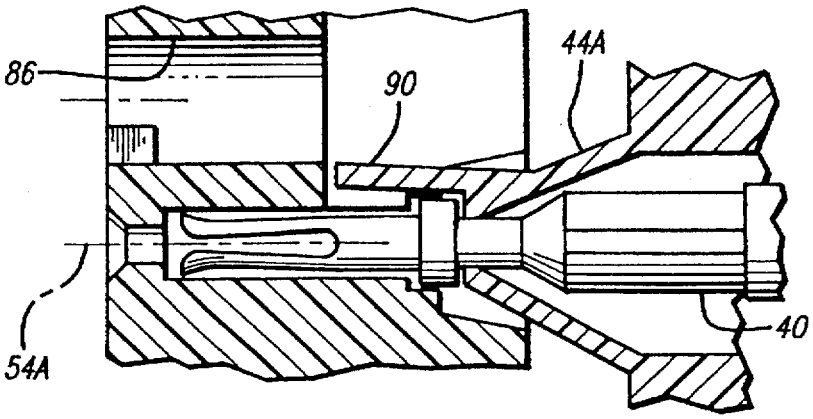
FIG. 6

CONTACT POSITION ASSURANCE DEVICE

BACKGROUND OF THE INVENTION

One type of connector includes an insulator having contact receiving passages, with a plurality of resilient tines lying around each passage. An electrical contact can be pushed forwardly through the passage until a shoulder on the contact passes abutting pars of the tines, so the abutting parts can snap to a position behind the shoulder to prevent removal of the contact. However, if the contact is not pushed forward far enough, then the tines may hold the contact with a small force, which allows the contacts to be pushed rearwardly out of position, during mating with other contacts. It would be desirable if a compact and low cost position assurance device were available thin indicated if any one of a number of contacts were not fully installed.

SUMMARY OF THE INVENTION

In accordance with one embodiment of the prevent invention, a connector is provided with a position assurance device of relatively simple and reliable construction. The connector has contact-receiving passages and a plurality of tines lying about each passage. The passages are arranged in groups of three that are equally distant from a group axis. A position assurance device includes a post that projects through a hole lying along the group axis, with each post having three blocking parts, with each blocking part lying adjacent to one of the plurality of tines at each passage. Thus, although a plurality of tines lie about each passage, only one tine is locked by the position assurance device. If a contact is not fully installed, then a tine which would lock the contact, prevents full insertion of the post, and resistance to full insertion of the post indicates that one of the three contacts has not been fully installed. The position assurance device also acts as a secondary lock that locks a tine to each fully installed contact.

Each first tine, which is the tine blocked by the position assurance device, has an abutting part that abuts the contact, and has an arm extending forwardly therefrom, with the post lying adjacent to the forwardly-projecting arm. Where the passages lie in rows, a bar-like holder can hold a plurality of posts that lie between two rows of passages.

The novel features of the invention are set forth with particularity in the appended claims. The invention will be best understood from the following description when read in conjunction with the accompanying drawings.

BRIEF DESCRIPTION OF THE DRAWINGS

FIG. 4 is a view similar to that of FIG. 3, but prior to installation of a contact.

FIG. 5 is a view similar to that of FIG. 4, but with the contact partially installed.

FIG. 6 is a view similar to that of FIG. 5, but with the contact fully installed, and with the position assurance device not yet installed.

DESCRIPTION OF THE PREFERRED EMBODIMENT

Figures 1, 2:
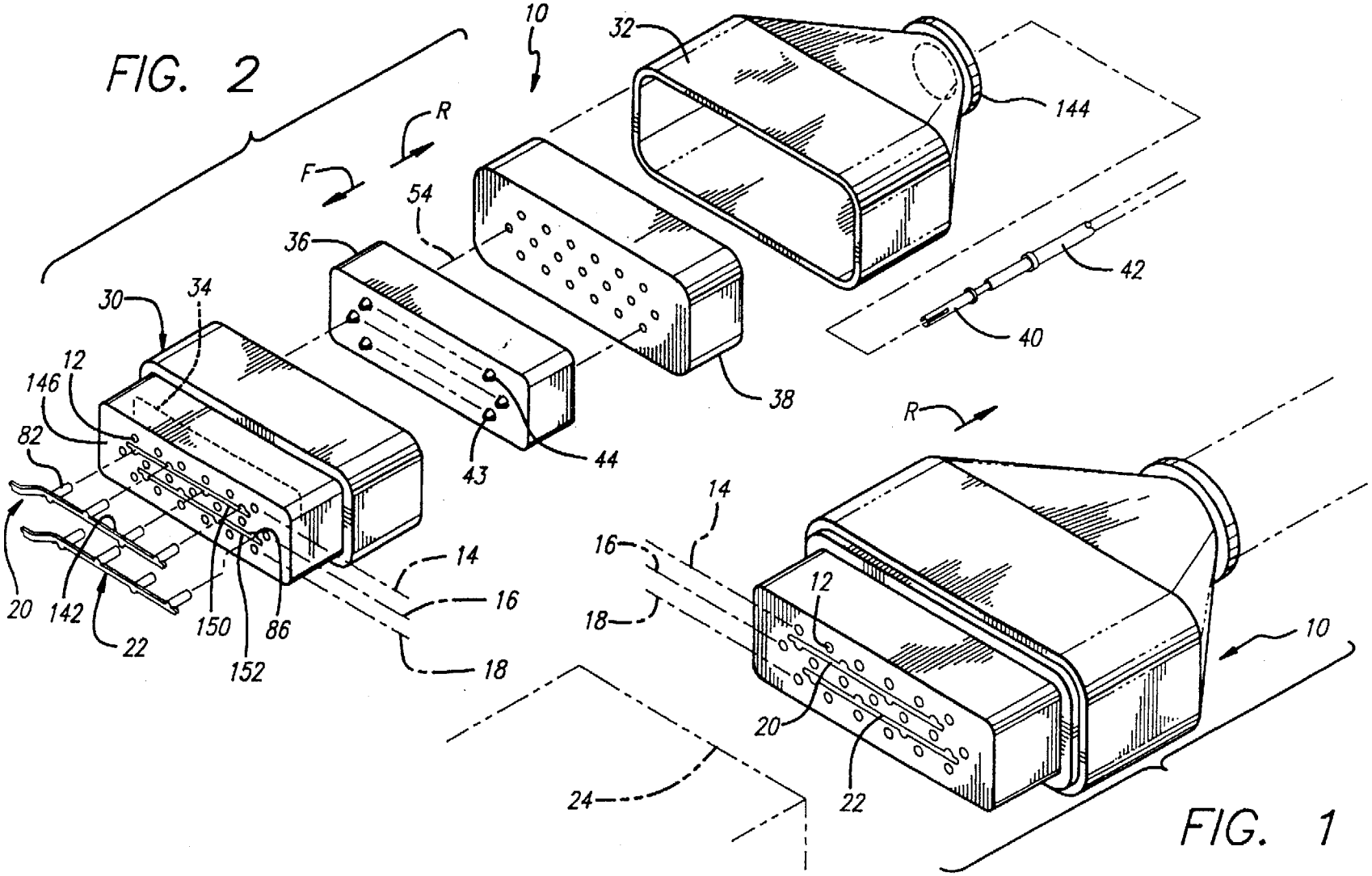
FIG. 1 is an isometric view of a connector constructed in accordance with the present invention.
FIG. 2 is an exploded isometric view of the connector of FIG. 1.

FIG. 1 illustrates a connector 10 with nineteen contact-receiving passages 12 arranged in three rows 14, 16, 18. The figure also shows a pair of secondary locks, or position assurance devices 20, 22 fully installed in the connector. The assurance devices assure that all contacts have been fully installed, and also prevent movement of contacts in a rearward direction R when the connector 10 mates with another mating connector indicated at 24.

FIG. 2 shows that the connector 10 includes forward and rearward shells 30, 32, with at least the forward shell 30 being formed of insulative material, so a portion 34 of the forward shell forms a forward insulator that lies forward of a separate rear insulator 36. A grommet 38 lies behind the rear insulator 36 and within the rear shell 32. A plurality of contacts 40 that are attached to the front ends of wires 42, extend through a hole in the rear shell 32, and through corresponding passage portions in the grommet 38, rear insulator 36, and forward insulator 34 of the front shell 30. It may be noted that the rear insulator 36 has a retainer 43 formed by a plurality of tines 44 lying around each passage, to hold each contact in place.

Figure 3:
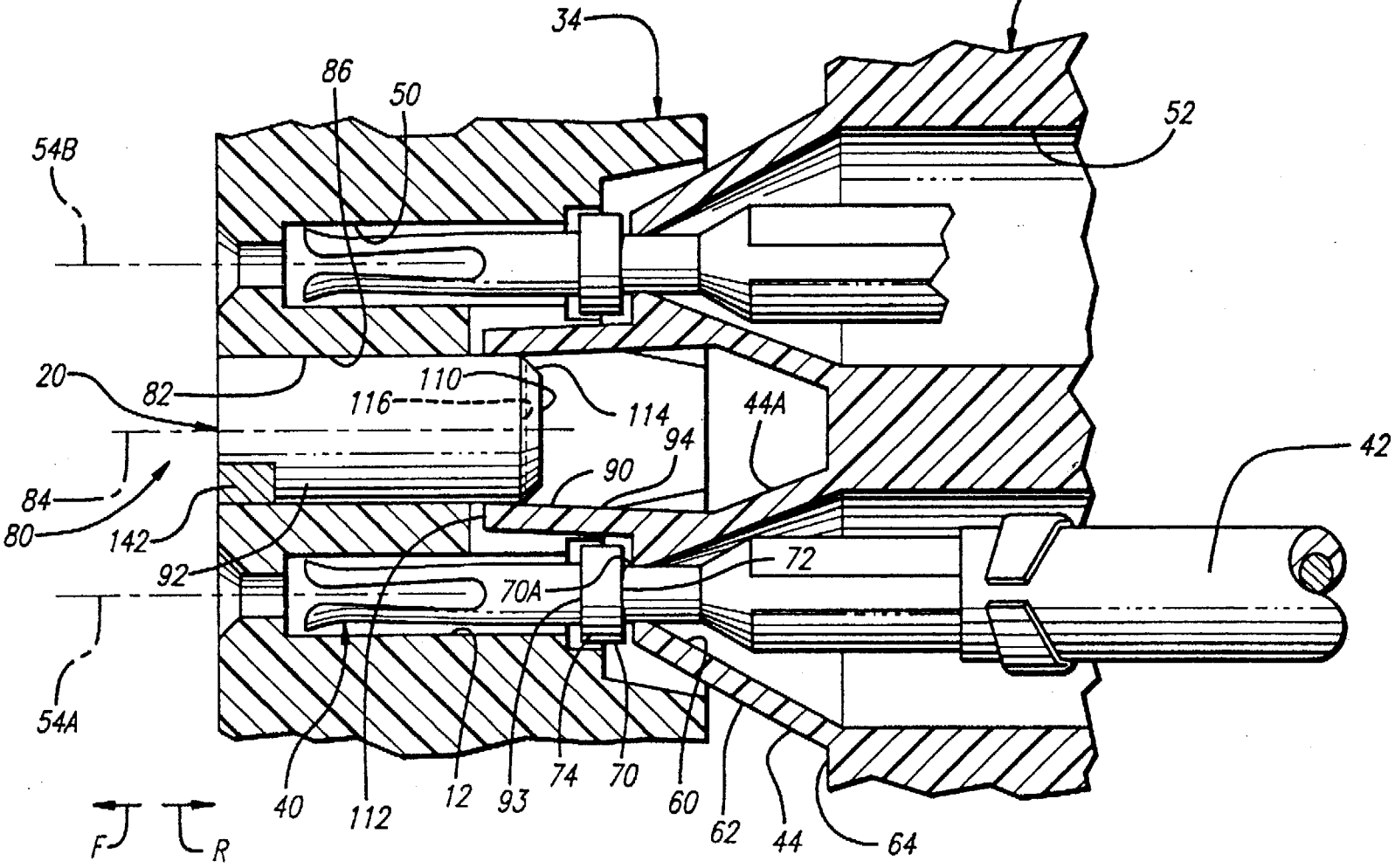
FIG. 3 is a sectional view of a portion of the connector of FIG. 1, with connectors and a secondary lock fully installed, and with FIG. 3 being a view taken on line 3—3 of FIG. 7.

As shown in FIG. 3, the front insulator portion or front insulator 34 and rear insulator 36 have aligned passage portions 50, 52, with each passage 12 having a passage axis 54, with two axes 54A, 54B being shown in the figure. Each group of tines 44 includes four tines, with radially inner and outer surfaces 60, 62 (radial with respect to the corresponding passage axis such as 54B). The tines extend with forward and radially-inward directional components from a front end 64 of the rear insulator member. The tines are shown integral with the rear insulator, although separate retainers with tines can be used. Each tine has an abutting part 70 that abuts a rearwardly-facing shoulder 72 formed on a flange 74 of a contact 40.

The four tines 44 that abut the contact rear shoulder 72, are usually sufficient to assure that the contact will not move rearwardly when a force is applied to it during mating with another contact. However, there is a danger that not all of the contacts will be fully installed, and therefore, one of the contacts might be positioned with its rearwardly-facing shoulder 72 not backed by the abutting parts 70 of the corresponding tines. Instead, a situation such as shown in FIG. 5 could occur, wherein the tines press firmly against the outside 75 of the flange 74, which conceals the fact that the contact has not been fully installed. Applicant provides a position assurance device which makes it highly noticeable if any one of the contacts is not fully installed, and which can also even more securely hold a fully installed contact in place.

In accordance with the present invention, applicant provides a secondary lock and position assurance device 20 (FIG. 3) which includes a post 82 that extends along a group axis 84 into a post-receiving hole 86 in the front insulator member 34. One of the four tines 44 is a first tine 44A which has an arm 90 that extends primarily forwardly from the abutting part 70A of that tine. The arm 90 is designed to be engaged by a blocking part 92 of the assurance device post. The arm preferably extends further forward than the front 93 of a fully installed contact flange 74 to "amplify" the position of the first tine. With the blocking part 92 of the post engaging a radially outer tine side 94, the arm 90 cannot move radially outwardly, away from the passage axis 54A, and therefore the abutting part 70A of the first tine cannot move out of a position directly rearwardly of the contact shoulder 72.

FIG. 4 shows the connector in a position that it assumes prior to insertion of a contact 40 along the passage 12. The contact 40 is shown extending through a hole 100 in the grommet 38 and partially through a passage portion 52 of the contact-receiving passage 12, but it has not yet reached the tines 44 or the forward passage portion 50.

FIG. 5 shows the contact 40 after it has been partially installed, by moving it forwardly until the flange 74 engages the tines 44 and moves them radially outwardly away from the passage axis 54A. The first tine 44A has been deflected so that its arm at 90X lies close to the group axis 84, where a position assurance post can be inserted. If the post 82 of FIG. 3 is inserted through the post-receiving hole 86, then the rear end 110 of the post will encounter the front end 112 of the arm, and the arm will resist full insertion of the post. A technician acquainted with the forces required to insert the post, will be aware of the resistance, and will be instructed to recheck the contacts to assure full insertion of all of them, if the assurance device encounters a resistance to full insertion. It is noted that the contact position shown in FIG. 5, is often the most likely erroneous contact position, because the light holding power of the tines 40 pressing against the contact flange 74 can provide just enough holding to falsely indicate that all contacts have been fully inserted. The fact that the assurance device post provides an indication of such error, greatly decreases the possibility of the presence of such partially installed contact.

FIG. 6 shows the contact 40 after it has been fully installed, but the position assurance post has not been installed in the hole 86. The resilience of the first tine at 44A results in it moving towards the passage axis 54A so that the arm at 90 is close to the original arm position shown in FIG. 4. Accordingly, when the post 86 is installed, as in FIG. 3, a beveled end 114 of the post can slightly deflect the arm to hold it in the position shown. It is also possible for the post to be positioned so it does not engage the arm but is adjacent to it. The post can be formed with a recess at 116, so that if the front end 112 of the arm juts out as in FIG. 5, the arm will be trapped in the recess in the post.

Figure 7:
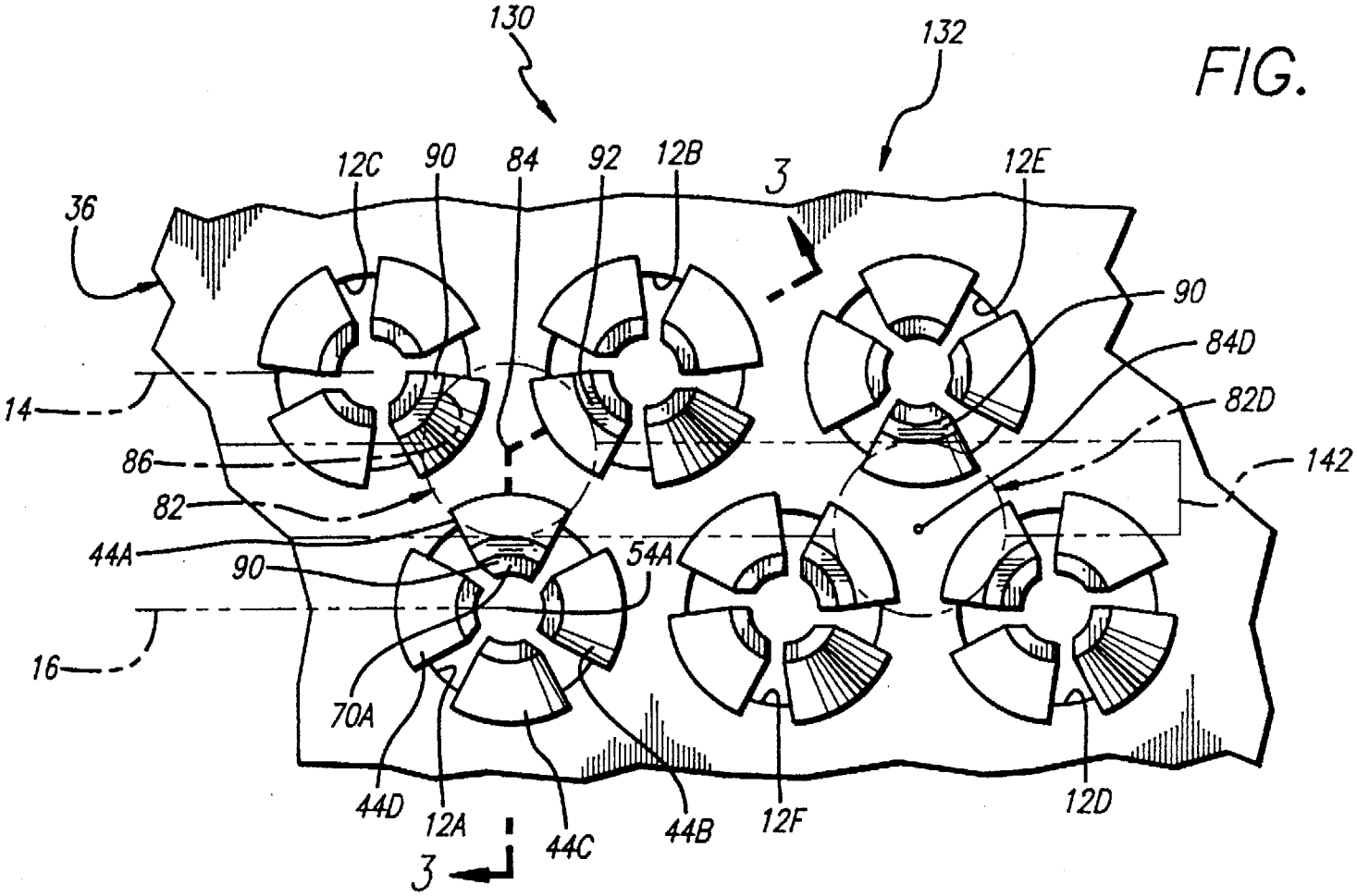
FIG. 7 is a front elevation view of a portion the connector of FIG. 1.

FIG. 7 shows the relative positions of three contact-receiving passages 12A, 12B, and 12C. The passages are equally distant from the first group axis 84, and from the largely cylindrical post 82 that extends along the axis. The rear insulator member 36 has four tines 44A–44D spaced about its corresponding axis such as 54A. There are preferably at least three tines and more preferably four tines in each set associated with one contact-receiving passage. The first tine 44A includes an arm 90 which extends forwardly of the abutting end or part 70A of that tine. The post 82 has three blocking parts 92, that each engages one of the arms 90 of a first tine of each of the three groups of tines centered about the first group axis 84. Thus, a single post 82 occupying a single post-receiving hole 86, can indicate the proper insertion of three contacts in the three passages 12A, 12B, and 12C, and can also lock in a first tine at each of the three passages. FIG. 7 also shows a second group axis 84D which is centered on three other passages 12D, 12E, and 12F. A post at 82D installed in a hole extending along the axis 84D engages first arms 90 on first tines at each of the three passages 12D–12F.

The contact-receiving passages shown in FIG. 7 are arranged in two parallel rows 14, 16. Two passages 12B, 12C of the first group 130 lie in the first row 14, while the third passage 12A lies in the second row 16. For the second group 132, one passage 12E lies in the first row 14 and two passages 12D, 12F lie in the second row 16. This arrangement permits the passages to be substantially equally spaced along each of the rows 14, 16. As shown in FIG. 2, the passages are arranged in three parallel rows 14, 16, 18 that are equally spaced apart. The connector includes two assurance devices 20, 22 that each carries four posts 82 that are held together by a holder 142. The posts 82 are arranged with alternate posts lying higher than posts in between to obtain the positioning shown in FIG. 7.

The connector is assembled by pressing the rear insulator 36 (FIG. 2) forwardly into a hollow rear of the shell 30. The grommet 38 is then pressed into the shell behind the rear insulator. The contacts 40 are threaded through an open rear end 144 of the rear shell and inserted through the grommet 38, rear insulator, and into the front insulator 34 of the front shell. Each of the position assurance devices 20, 22 is pressed rearwardly with a light to moderate force so the posts 82 enter the post-receiving passages 86. Instructions inform the technician that if a resistance to full insertion of a position assurance device is encountered, that the contacts be checked to be sure that they are all fully installed. The technician can insert a tool similar to one of the posts, or use one of the end posts 82, for insertion into a single hole at a time, to determine which post-receiving hole provides resistance to full post insertion. The front end 146 of the forward shell has recesses 150, 152 for receiving the bar-like holders 142 of the assurance devices, so the holders do not project forwardly from the front end of the forward shell.

The fully inserted post can be retained in a number of ways. Where the arms of the first tines press against the sides of the post, such friction can hold the posts in place. Of course, a variety of means such as ribs on the posts or holder or in the post-receiving holders or recesses can be provided.

Thus, the invention provides a secondary lock and position assurance device for a connector, which not only helps retain contacts in their proper position, but also indicates when a contact has not been fully installed. The connector has a retainer that includes at least one tine with an abutting part that rides over a contact flange during contact insertion, and which snaps behind a shoulder on the contact when the contact is fully installed. If the contact is only partially installed so the tine rests against the outside of a contact flange, the tine remains radially outwardly deflected. As a result, when a post of an assurance device is installed, the first tine interferes with full installation of the assurance device post, which indicates that a contact has not been fully installed. If the contact has been fully installed and an abutting portion of the first contact lies behind the contact flange and substantially against a rearwardly-facing shoulder on the contact flange, the assurance device post can be fully installed. The post then prevents radially outward deflection of the first tine, so that it more reliably holds the contact in position.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector for holding a plurality of contacts that each has a rearwardly-facing shoulder, comprising:

an insulator which has a plurality of contact-receiving passages with parallel passage axes that extend in forward and rearward directions for receiving contacts, and a plurality of resilient tines lying around each of said passages, with said contacts each being installable into one of said passages by insertion of the contact in a forward direction therein until a plurality of tines around the passage snap to a position immediately behind the contact shoulder;

said plurality of passages includes a first group of three contact receiving passages clustered around a first group axes which extends substantially parallel to said passage axes, said insulator having a first post-receiving hole extending along said first group axis; and a device which includes a post extending along said group axis, with said post having three blocking parts with each blocking part lying adjacent to a first tine of a different passage of said group of passages, to prevent each first tine from deflecting away from a position directly rearward of the shoulder of a corresponding contact, and to prevent full installation of the post if any of said first tines is deflected away from said position.

2. The connector described in claim 1 wherein:

said passages lie in at least first and second straight rows, with the passages in said second row staggered with respect to the passages in said first row;

said plurality of passages includes a second group of three contact receiving passages clustered around a second group axis, and said insulator has second post-receiving hole extending along said second group axis;

said device includes a second post having blocking parts lying adjacent to a first tine at each passage of said second group;

said first and second groups being arranged so said first group includes two passages of said first row and one passage of said second row, and said second group includes one passage of said first row and two passages of said second row, with said groups lying adjacent wherein said passage of said first row of said second group lies adjacent to one of said passages of said first row of said first group.

3. The connector described in claim 1 wherein:

each of said plurality of tines that lies around a passage, has an abutting part for abutting a contact shoulder, and each of said first tines has an arm that extends forwardly of the abutting part of the first tine, and said post blocking parts each lies adjacent to one of said arms.

4. The connector described in claim 1 wherein:

said tines each have inner and outer sides that both extend generally forward with a radially inward directional component toward a corresponding passage axis, except that said arm of said first tine has an outer tine side that extends substantially parallel to said first passage axis.

5. The connector described in claim 1 wherein:

said plurality of passages includes a plurality of groups of passages, including said first group, with each group including a plurality of passages clustered around a group axis, and with said insulator having a post-receiving hole extending along each of said group axes;

said device includes a plurality of secondary post members, including said post, with each post member lying in one of said post-receiving holes and having a blocking part lying adjacent to a first tine of a different passage of the group, and with each post member having a forward end;

a holder extending largely perpendicular to said passage axes and connecting together said forward ends of said posts.

6. The connector described in claim 5 wherein:

said holder is substantially straight, and said posts are spaced apart along said holder.

7. The connector described in claim 5 wherein:

said insulator has a front end with a recess that closely receives said holder.

* * * * *